US006744995B2

(12) United States Patent
Fukuyama et al.

(10) Patent No.: US 6,744,995 B2
(45) Date of Patent: Jun. 1, 2004

(54) ELECTROPHOTOGRAPHIC IMAGE FORMING APPARATUS

(75) Inventors: Hirotaka Fukuyama, Mishima (JP); Koichiro Sato, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 47 days.

(21) Appl. No.: 10/279,031

(22) Filed: Oct. 24, 2002

(65) Prior Publication Data

US 2004/0081474 A1 Apr. 29, 2004

(51) Int. Cl.[7] ..... G03G 15/02; G03G 15/08

(52) U.S. Cl. ..... 399/50; 399/49; 399/53; 399/169

(58) Field of Search ..... 399/168, 169, 399/50, 49, 53, 55, 56

(56) References Cited

U.S. PATENT DOCUMENTS 5,835,821 A * 11/1998 Suzuki et al. ..... 399/50

FOREIGN PATENT DOCUMENTS

| | | | | |
|---|---|---|---|---|
| JP | 58211173 A | * | 12/1983 | ..... G03G/15/09 |
| JP | 62070891 A | * | 4/1987 | ..... G03G/21/00 |
| JP | 63175871 A | * | 7/1988 | ..... G03G/15/02 |
| JP | 63175872 A | * | 7/1988 | ..... G03G/15/04 |
| JP | 03240077 A | * | 10/1991 | ..... G03G/15/02 |
| JP | 11-202685 A | | 7/1999 | |

* cited by examiner

*Primary Examiner*—Susan S. Y. Lee
(74) *Attorney, Agent, or Firm*—Foley & Lardner LLP

(57) ABSTRACT

A high image quality electrophotographic image forming apparatus is provided without increasing the size and cost, and reducing the life thereof. The potential difference (contrast potential) between a photoreceptor and a development roller for supplying toner to the photoreceptor by the use of a carrier is set to be smaller in the non-image area irrelevant to the printing operation, and set to be larger in the image area relevant to the printing operation. In this manner, the damage to the photoreceptor caused by the adhesion of the carrier is reduced in the non-image area irrelevant to the printing operation, and the fog is reduced in the image area relevant to the printing operation.

7 Claims, 4 Drawing Sheets

ELECTROPHOTOGRAPHIC IMAGE FORMING APPARATUS

BACKGROUND OF THE INVENTION

1. Field of the Invention

The present invention relates to an electrophotographic image forming apparatus.

2. Related Background Art

An electrophotographic image forming apparatus, such as a copying machine, includes a photoreceptor for printing a visible image, formed by toner, on paper serving as a recording medium (object to be printed on), and a developing unit for supplying toner to the photoreceptor using a development roller (magnet roller). The developing unit may include a two-component developing unit using a mixture of a non-magnetic toner and a magnetic carrier as a developer. In recent years, the demand for high-quality image is increased, particularly in the field of full-color electrophotographic image forming apparatuses. As a result, the reduction in particle size of magnetic carriers is being advanced. A problem with the reduction in particle size of carriers lies in that the margin of white background contrast potential (potential difference between the white background potential of the photoreceptor and the development bias of the development roller) is reduced. If the white background potential (potential difference) is too large, the carrier particles tend to adhere to the photoreceptor, resulting in that scratches and abrasions may appear on the photoreceptor. On the contrary, if the white background potential is too small, the entire paper may be darkened (fogged). Because of this, generally the white background contrast potential (potential difference) is set to be at a value satisfying both the carrier adherence property and the fogging property. However, when the size of carrier particle is reduced, the margin of the white background contrast potential (potential difference) is also reduced. Because of this, it is difficult to use carriers having a smaller particle size.

In order to solve this problem, conventional electrophotographic image forming apparatuses have been provided with a sensor for detecting the potential of the photoreceptor to achieve a high-accuracy white background potential, thereby adjusting the white background contrast potential (potential difference) so as to be within the margin. This enables the use of carriers with smaller particle size. However, the existence of the photoreceptor potential sensor leads to an increase in both the size and the cost of the apparatuses. This goes against the recent tendency of reduced size and lower cost. In particular, in the field of four-drum tandem color electrophotographic image forming apparatuses, such a problem is critical since there are four photoreceptors in these apparatuses.

SUMMARY OF THE INVENTION

The present invention is proposed in consideration of the above-described problem, and the object of the present invention is to provide a high image quality electrophotographic image forming apparatus, which can use carriers with smaller particle sizes without including any sensor system, which inevitably increases the size of the apparatus, and without increasing the costs.

According to embodiments of the present invention, there is provided an electrophotographic image forming apparatus comprising: a photoreceptor which is rotatable, and a surface of which can be uniformly charged at a voltage level, the surface attracting a toner for printing with an electrostatic force, the toner being transferred to an object to be printed on, such as paper, to perform an printing operation, and said photoreceptor rotating predetermined times during the printing operation; a charging unit for charging the surface of the photoreceptor to be either at a first white background potential or at a second white background potential; an exposing unit for forming an electrostatic print pattern on the surface of said photoreceptor set to be at the second white background potential, to form a latent image; a developing unit having a rotatable development roller, which rotates with a developer adhering to the surface thereof, the developer including a carrier and the toner attracting each other by an electrostatic force, the toner adhering to the latent image on the surface of the photoreceptor by the electrostatic force, a development bias being applied to the development roller, a potential difference between the development bias and the first white background potential being a first contrast potential, a potential difference between the development bias and the second white background potential being a second white background contrast potential, and an absolute value of the second white background contrast potential being greater than an absolute value of the first white background potential; and a control unit for controlling the charging unit so that a part of a total surface area corresponding to all the turns of the photoreceptor during a printing operation is charged to be at the second white background potential, the part corresponding to a predetermined number of turns relevant to the printing operation, and that the rest of the total surface area corresponding to the rest of turns is charged to be at the first white background potential.

According to embodiments of the present invention, there is provided a development method using an electrophotographic image forming apparatus, comprising: rotating a photoreceptor predetermined times, charging a first part of the total surface area corresponding to all the turns of the photoreceptor to be at a first white background potential by the use of a charging unit, the first part being irrelevant to the printing operation; charging a second part of the total area of the photoreceptor relevant to the printing operation to be at a second white background potential, the value of the second white background potential being different from that of the first white background potential; forming an electrostatic pattern of a latent image on the second part of the total surface area of the photoreceptor charged to be at the second white background potential by the use of an exposing unit, supplying a developer composed of a toner and a carrier attracting each other by an electrostatic force to the latent image on the second part of the total surface area of the photoreceptor by the use of a development roller charged to be at a development bias potential; and allowing the toner to adhere to the latent image on the second part of the total surface of the photoreceptor by the electrostatic force, wherein with respect of the absolute value of the potential difference between the photoreceptor and the development roller, the absolute value of a second contrast potential, which is the potential difference between the second white background potential of the second part relevant to the printing operation and the development bias potential of the development roller is larger than the absolute value of a first contrast potential, which is the potential difference between the first white background potential of the first part irrelevant to the printing operation and the development bias potential.

DESCRIPTION OF THE PREFERRED EMBODIMENTS

Figure 3:
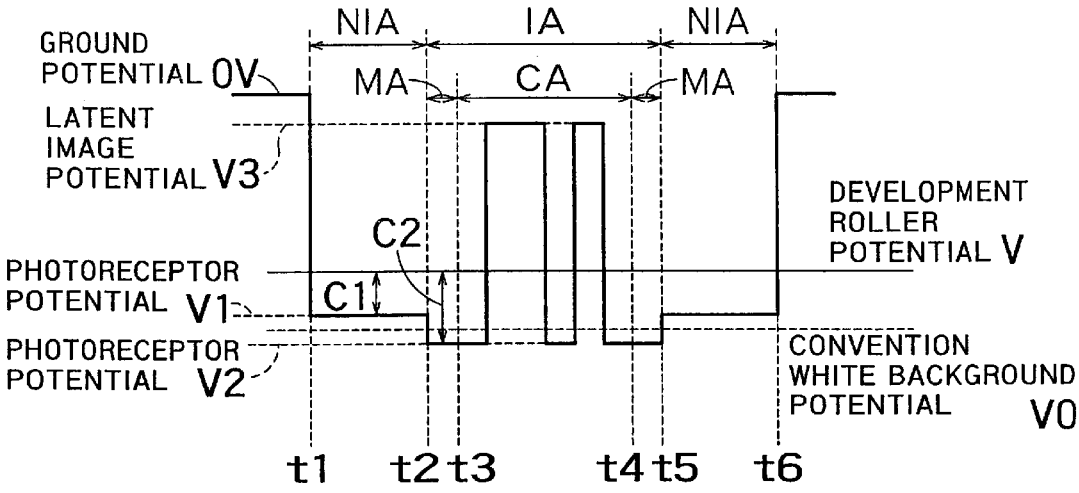
FIG. 3 is a graph sequentially showing an example of changes in potential of the circumference of a photoreceptor of the electrophotographic image forming apparatus according to the embodiment of the present invention when the photoreceptor makes several turns.

Hereinafter, an electrophotographic image forming apparatus according to an embodiment of the present invention will be described with reference to the accompanying drawings. One of the characteristic features of the electrophotographic image forming apparatus according to the embodiment lies in that, as shown in FIG. 3, the white background potential of the photoreceptor is set to be at V1, the absolute value of which is smaller, in the non-image area NIA, which is irrelevant to the printing operation, and set to be at V2, the absolute value of which is greater, in the image area IA, which is relevant to the printing operation. Accordingly, the potential difference between the photoreceptor and the development roller (contrast potential) becomes C1, which is smaller, in the non-image area NIA, and C2, which is greater, in the image area IA. As a result, it is possible to reduce damage to the photoreceptor caused by the adhesion of carriers in the non-image area NIA irrelevant to the printing operation, and it is possible to reduce the degree of fog in the image area IA relevant to the printing operation.

Hereinafter, the structure and the basic operation of the electrophotographic image forming apparatus will first be described with reference to FIG. 1; the method of controlling this apparatus will then be described with reference to FIGS. 2 and 3; and the advantageous effects of this apparatus will be described with reference to FIGS. 4 and 5.

First, the structure and the basic operation of the electrophotographic image forming apparatus will be described.

Figure 1:
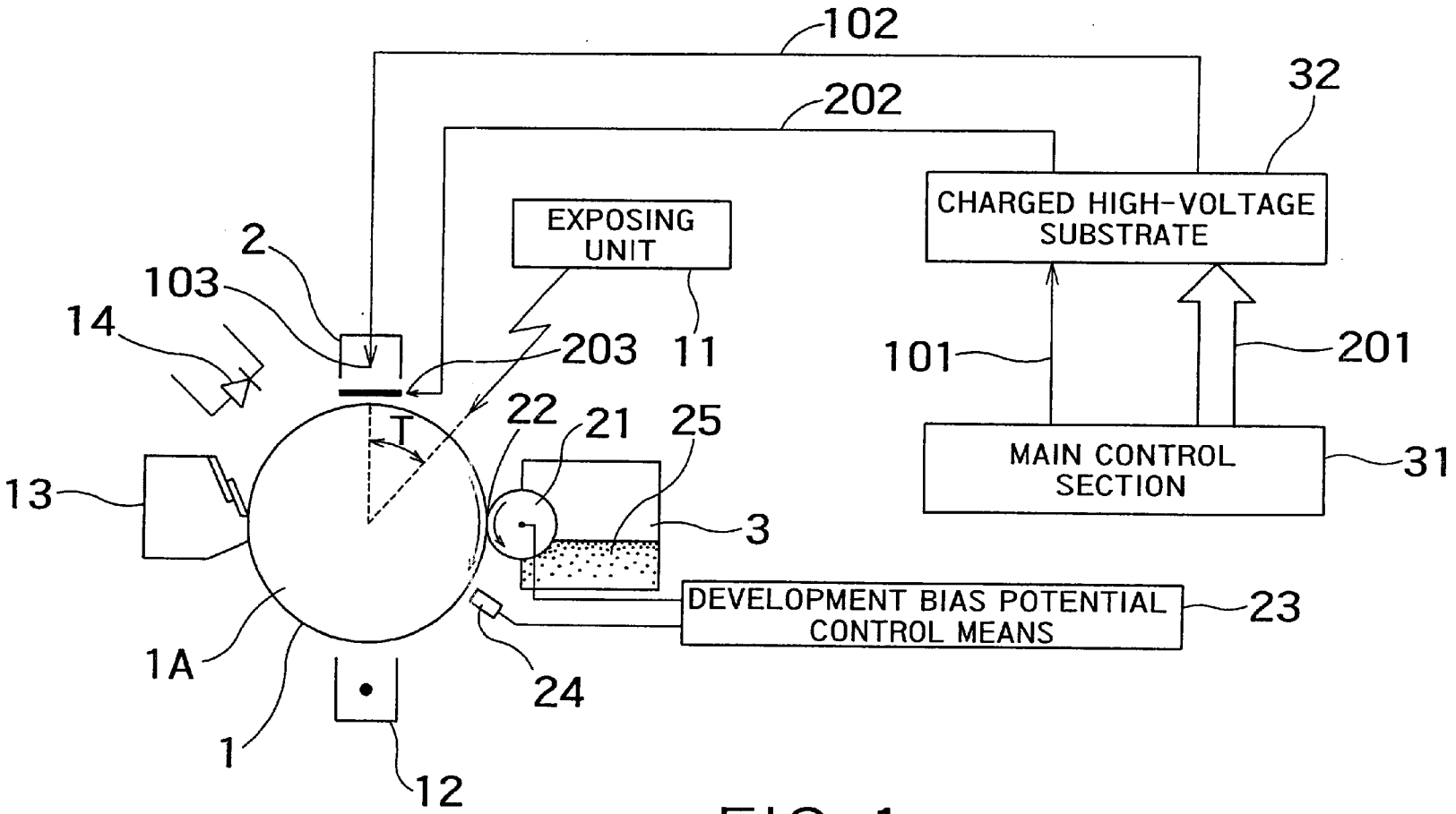
FIG. 1 is a schematic diagram showing the main part of an electrophotographic image forming apparatus according to an embodiment of the present invention.

FIG. 1 shows the main part of an electrophotographic image forming apparatus according to an embodiment of the present invention. This apparatus includes a photoreceptor 1, an exposing unit 11, a scorotron charging unit 2, a control unit 31 and 32, and a developing unit 3. These will be described below.

The photoreceptor 1, which is rotatable, is formed by coating a drum-shaped aluminum base pipe (photoreceptor drum 1A) with an organic photo conductor. The circumference of the photoreceptor 1 is, for example, 100 mm. Accordingly, in order to print on a sheet of paper having the length of, for example, 420 mm, the photoreceptor should make 4.2 turns. The potential of the photoreceptor 1 is set to be at a predetermined minus reference potential, which is either a first white background potential V1 or a second white background potential V2.

The photoreceptor 1 makes several turns (for example, eight turns) in the printing operation, of which, for example, 4.2 turns are for making a latent image on the outer surface thereof. The potential graph of FIG. 3 can be obtained during such an operation. This operation will be described below with reference to FIG. 3. The photoreceptor 1 makes, for example, eight turns during a period from time t1 to time t6 in the printing operation. Of the total surface area corresponding to all turns (eight turns), a portion corresponding to a predetermined number of turns (a period from t2 to t5) relating to the printing on a recording medium (paper) will be referred to as "image area IA", and the rest (periods from t1 to t2, and from t5 to t6) will be referred to as "non-image area NIA." The image area IA includes a copying area CA corresponding to, e.g., 4.2 turns for contacting paper (a period from t3 to t4), and margin areas MA corresponding to the portions immediately before and after the copying area CA (period from t2 to t3, and from t4 to t5). A latent image is formed on the copying area CA. That is, with reference to FIG. 3, the photoreceptor 1 is stopped during a period of time in which the apparatus shown in FIG. 1 is in a stand-by state. At this time, the potential of the photoreceptor 1 is at the ground potential (0 V) as appearing in the period of time before time t1 in FIG. 3. When, for example, a "copy start" button is pushed down to start the copying operation, the potential of the photoreceptor 1 is forcibly changed to the first white background potential V1 by the scorotron charging unit 2. The photoreceptor 1 rotates several times, and at time t2 when the image area IA starts, the potential of the photoreceptor 1 is forcibly changed to the second white background potential V2 by the scorotron charging unit 2. During the period of time from time t3 to time t4, a latent image pattern is formed on a portion of the total area of the photoreceptor 1 corresponding to the copying area CA (the portion corresponding to 4.2 turns of the photoreceptor 1), the potential of which has been changed to the second white background potential V2, by the exposing unit 11 with a latent image potential of V3. At time t4, the copying area ends, and a margin area MA starts, which lasts until time t5. Until time t5, the potential of the surface of the photoreceptor 1 is basically maintained to be at the second white background potential V2. The period from time t5 to time t6 corresponds to the non-image area NIA, during which the photoreceptor 1 rotates, and the potential of the photoreceptor 1 is set to be at the first white background potential V1. At time t6, the copying operation is finished, and the potential changing operation by the scorotron charging unit 2 is also finished. The period after time t6 is the stand-by period mentioned above, and the surface potential of the photoreceptor 1 is reset to be at the ground potential 0 V.

As described above, during the period from time t1 to time t6, the photoreceptor 1 makes several turns (eight turns), of which a predetermined number of turns made in the period from t2 to t5 are used for printing on paper. Further, in this embodiment, the first and second white background potentials V1 and V2 are used. That is, the white background potential of the image area IA relevant to the printing operation is set to be at the second white background potential V2 (−480 V), the absolute value of which is greater than the conventional white background potential V0 (−420 V), and the white background potential of the non-image area NIA irrelevant to the printing operation is set to be at the first white background potential V1 (−360 V), the absolute value of which is smaller than the conventional white background potential (−420 V). The potential of the portion of the total surface area of the photoreceptor 1 corresponding to the copying area CA is first set to be at the second white background potential V2. Then, a predetermined electrostatic latent image is selectively formed on the copying area with the potential of V3 (−50 V) by the exposing unit 11. Thereafter, the operation goes on in the same manner as the general-purpose apparatuses. That is, the portion on which the electrostatic latent image is formed rotates clockwise, as shown in FIG. 1, to reach the developing unit 22. At the developing unit 22, toner (negatively charged) supplied from the development roller 21 adheres to the electrostatic latent image to form a visible image. Then, in a transfer charger 12 in the next stage, the visible image formed by the toner is transferred to the paper having been fed there. The residual toner, which was not used for printing on the paper, is then cleaned by a cleaning blade 13. After the cleaning, static electricity on the photoreceptor 1 is removed by a static eliminating lamp 14. Thereafter, the photoreceptor 1, from which static electricity has been removed, reaches the scorotron charging unit 2.

In the apparatus of this embodiment, the white background potential is controlled to have two stages, i.e., V1 and V2, by the scorotron charging unit 2, as described above. The scorotron charging unit 2 is controlled by a control section including a main control section 31 and a charged high-voltage substrate 32, as shown in FIG. 1. Specifically, a grid 203 and a wire 103 of the scorotron charging unit 2 are connected to the charged high-voltage substrate 32, and are supplied with a high voltage from the charged high-voltage substrate 32. The charged high-voltage substrate 32 is connected to the main control section 31, so that a charged high-voltage control signal 101 and a grid control signal 201 are supplied from the main control section 31 to the charged high-voltage substrate 32. One of the signals, the charged high-voltage control signal 101, turns ON/OFF a charged high voltage 102 and a grid high voltage 202 outputted from the charged high-voltage substrate 32. The other of the signals, the grid control signal 201, changes the output value of the grid high voltage 202 outputted from the charged high-voltage substrate 32. The white background potential of the photoreceptor 1 is controlled by the output value of the grid high voltage 202. As understood from FIG. 3, in the total surface area corresponding to all turns of the photoreceptor 1 in the printing operation (the period from time t1 to time t6), the surface area corresponding to a predetermined number of turns relating to the printing operation (the period from time t2 to time t5) is charged to be at the second white background potential V2, and the surface area corresponding to the rest of turns (the periods from time t1 to time t2, and from time t5 to time t6) is charged to be at the white background potential V1.

The developing unit 3 is filled with a developer 25, which is a mixture of two components, one being a non-magnetic toner that can be negatively charged, and the other being a magnetic carrier that can be positively charged. The non-magnetic toner is composed of colored chargeable fine powder. The magnetic carrier is composed of a magnetic material containing iron, ferrite, or magnetite, the average particle size of which is larger than that of the non-magnetic toner. The non-magnetic toner adheres to the magnetic carrier due to the electrostatic force caused by the charging. In this embodiment, the particle size of the magnetic carrier is small. Specifically, the 50% average particle size of the magnetic carrier is 30 $\mu$m or more and 70 $\mu$m or less, and the magnetic carrier includes more than 0% and less than 1% of carrier particles, the particle size of which is less than 22 $\mu$m. It is possible to achieve a high-quality image by reducing the size of magnetic carrier particles. In the developing unit 3, first the developer 25 is agitated by a mixer (not shown), so that the magnetic carrier and the non-magnetic toner are positively and negatively charged, respectively. Accordingly, the carrier attracts the toner by the electrostatic force. Thereafter, the development roller 21 rotates with the developer 25, which consists of the carrier and the toner attracting each other by the electrostatic force, adhering to the surface of the development roller, so that the toner adheres to the portion of the photoreceptor 1 where the latent image is formed by the electrostatic force. More specifically, the development roller 21 includes a magnet therein, and a development bias V (−300 V) is applied to the development roller 21 by a development bias potential control means 23. With the magnetic force, the development roller 21 attracts the carrier, which has attracted the toner by the electrostatic force. Then, the development roller 21 rotates to carry the developer 25 to the developing section 22. At the developing section 22, both the development roller 21 and the photoreceptor 1 rotate, contacting each other. At the developing section 22, the non-magnetic toner separates from the carrier to move to a portion of the photoreceptor 1 where the latent image is formed by the electrostatic force. As mentioned before, the toner adhering to the portion of the photoreceptor 1 where the latent image is formed becomes a visible image.

The structure and the basic operation of the apparatus of FIG. 1 have been described above.

Next, a method of controlling the electrophotographic image forming apparatus of FIG. 1 will be described with reference to FIGS. 2 and 3. One of the characteristic features of the method of controlling the apparatus of this embodiment lies in that, as described above, the white background potential of the photoreceptor 1 is set to be at the first white background potential V1, the absolute value of which is smaller, in the non-image area (the periods from time t1 to time t2, and from time t5 to time t6), which relates to the printing operation, and set to be at the second white background potential V2, the absolute value of which is larger, in the image area (the period from time t2 to time t5), which does not relate to the printing operation. FIG. 2(*e*) shows this. Herein after, for the convenience of explanation, it will be assumed that the circumference of the photoreceptor 1 is 100 mm, the rotational speed of the photoreceptor is 1.4 turns per second, the moving time T in which the photoreceptor 1 moves from immediately below the charging unit 3 to immediately below the exposing unit 11 is 0.1 seconds, and the size of the copying material serving as a recording medium is A3 (about 420 mm in length and about 300 mm in width).

Figure 2:
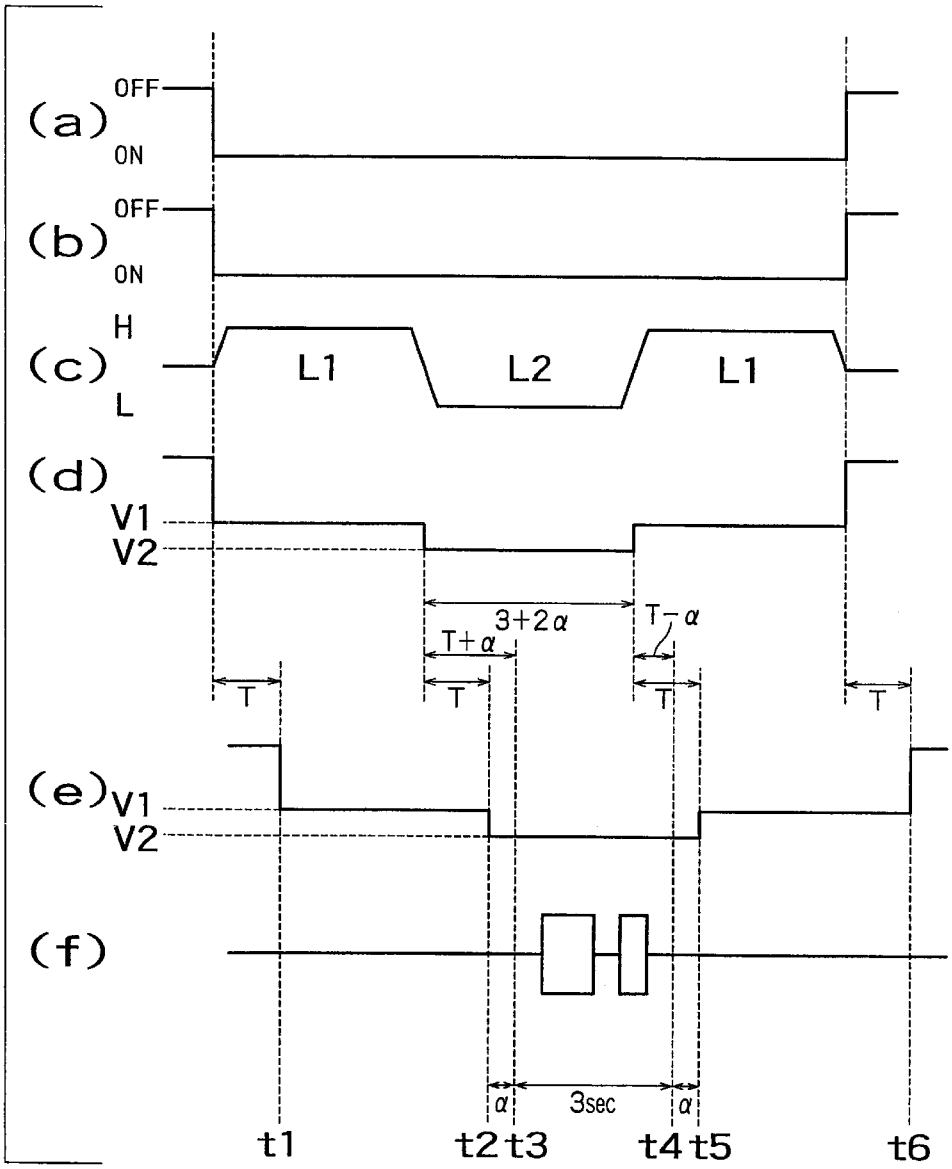
FIGS. 2(*a*)–2(*f*) are timing charts of control signals of the electrophotographic image forming apparatus according to the embodiment of the present invention.

FIGS. 2 (*a*) to 2(*e*) are timing charts representing the signals relating to the apparatus of FIG. 1. FIGS. 2(*a*) to 2(*d*) represent the signals of the charging unit 2, and FIGS. 2(*e*) and 2(*f*) represent the signals of the exposing unit 2. As described above, the time required for the photo receptor 1 to rotate and move from the charging unit 2 to the exposing unit 11 is T. Accordingly, the signals of FIGS. 2(*e*) and (*f*) are delayed for the time T from the signals of FIGS. 2(*a*) to 2(*d*). In more detail, FIG. 2(*a*) represents a photoreceptor driving/developing unit driving signal for activating the photoreceptor 1 and the developing unit 3; FIG. 2(*b*) represents a charged high-voltage control signal 101 for controlling ON/OFF operations of the charged high voltage 102 and the grid high voltage 202; FIG. 2(*c*) represents a grid control signal 201 for controlling the white background potential of the photoreceptor 1; and FIG. 2(*d*) represents the potential of the photoreceptor 1 at the portion facing the charging unit 2. FIG. 2(*e*) represents the potential of the photoreceptor 1 at the portion facing the exposing unit 11; and FIG. 2(*f*) represents the signal for turning ON/OFF the exposing image information from the exposing unit 11.

First, as shown in FIG. 2(*a*), the photoreceptor driving/developing unit driving signal is turned ON. In sync with the photoreceptor driving/developing unit driving signal, the charged high voltage control signal 101 is also turned ON, as shown in FIG. 2(*b*), to set the grid control signal 201 to be at level information L1 (H level). As the charged high voltage control signal 101 is turned ON and the grid control signal 201 is set to be at level information L1, the charged high-voltage substrate 32 outputs the charged high voltage 102 to the wire 103 of the scorotron charging unit 2 and outputs the grid high voltage 202 to the grid 203. Accordingly, the white background potential V1 (−360 V) is applied to the surface of the photoreceptor 1 facing the charging unit 2, as shown in FIG. 2(*d*).

Next, as shown in FIG. 2(*c*), the grid control signal 201 switches the level information L1 (H level) to the level information L2 (L level). Accordingly, the white background potential V2 (−480 V) is applied to the photoreceptor 1, as shown in FIG. 2(*d*). Time T (0.1 second) later, the white background potential of the portion of the photoreceptor 1 facing the exposing unit 11 becomes V2 (at time t2).

Then, time a after the white background potential of the portion of the exposing unit 11 facing the photoreceptor 1 becomes V2 (at time t3), the exposing unit 11 outputs exposure image information to start the formation of the latent image. In other words, (T+α) time before the start (t3) of writing the exposure image information (f), the level information L1 of the grid control signal (c) is changed to L2.

Next, as shown in FIG. 2(*f*), the exposure image information is outputted from the exposing unit 11 to the copying area of the photoreceptor 1 for three seconds (the period from time t3 to time t4). The reason why the exposure image information (f) is outputted for three seconds is that the length of the copying material is 420 mm and the moving speed of the photoreceptor 1 is 140 mm/s. As the result, a latent image of electrostatic pattern is formed by the exposing unit 11 on the surface of the photoreceptor 1 where the potential has been set to be at the second white background potential V2.

Then, time a after the output of the exposure image information (f) is terminated (t4) (t5), the white background potential (e) of the portion of the photoreceptor 1 facing the exposing unit 11 is set to be at V1. This change in white background potential is performed by changing level information of the grid control signal (c) from L2 to L1 time (T−α) before the termination of the output of the exposure image information (f).

Subsequently, the photoreceptor driving/developing unit driving signal (a) and the charged high voltage control signal (b) are turned OFF to finish the process.

FIG. 3 shows the potential of a portion of the surface of the photoreceptor 1, which faces the exposing unit 11. Times t1 to t6 correspond to those in FIG. 2. The white background potential of the photoreceptor 1 is set to be at V2 (−480 V), the absolute value of which is greater, in the image area IA including the copying area CA to which the object to be printed on serving as a recording medium is fed, and the margin areas MA before and after the copying area CA. In the rest, i.e., non-image area NIA, it is set to be at V1 (−360 V), the absolute value of which is smaller. As described above, the development bias of the development roller 21 is set to be at V (−300 V). Accordingly, the white background contrast potential (potential difference) is C1 (60 V) in the non-image area NIA which does not relate to the printing operation, and C2 (180 V) in the image area IA, which relates to the printing operation. An electrostatic latent image at the potential of V3 (−50 V) is formed on the copying area CA based on the exposure image information (FIG. 2(*f*)).

In the above-described electrophotographic image forming apparatus of this embodiment, the quality of image is high since the particle size of the carrier is small.

Further, in the electrophotographic image forming apparatus of this embodiment, the white background contrast potential (potential difference) C2 of the image area IA, which relates to the printing operation, is greater than the white background contrast potential (potential difference) C1 of the non-image area NIA, which does not relate to the printing operation, resulting in that the amount of the fog in the image area IA relevant to the printing operation is reduced, thereby further improving the image quality during the printing operation. Moreover, although the number of the carrier particles adhering to the photoreceptor 1 in the image forming area IA relevant to the printing operation increases, the number of carrier particles adhering to the photoreceptor 1 in the non-image area NIA irrelevant to the printing operation decreases, resulting in that the life of the photoreceptor 1 can be maintained at the same level as the conventional apparatuses. Hereinafter, explanations will be made with reference to FIGS. 4 and 5.

Figure 4:
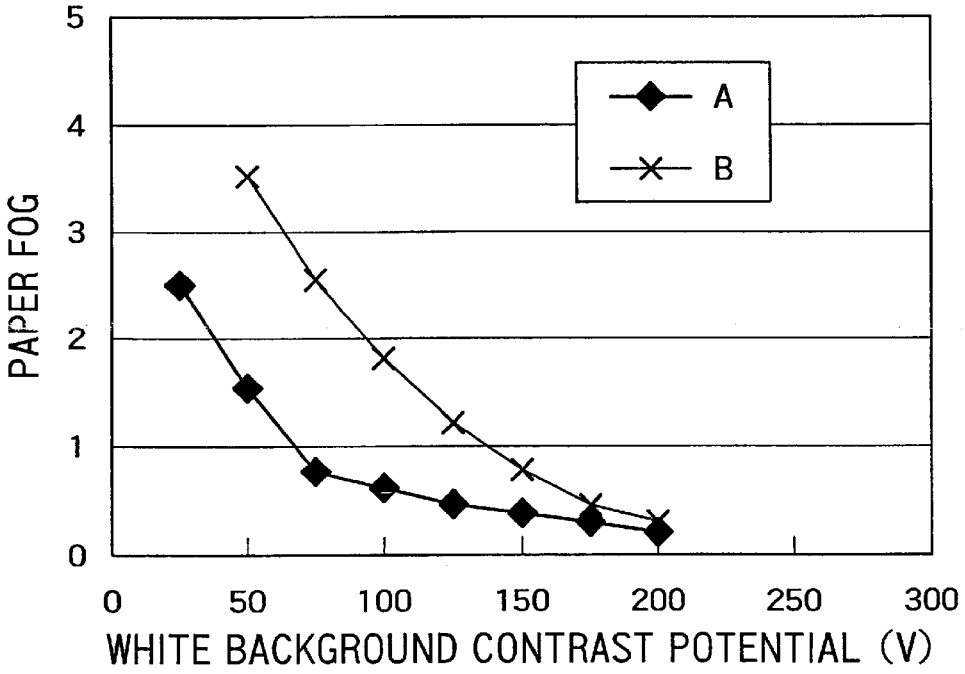
FIG. 4 shows graphs representing the relationship between the white background contrast potential (potential difference) and the paper fog of the electrophotographic image forming apparatus according to the embodiment of the present invention, these results obtained through experiment by the present inventor.

FIG. 4 shows the relationship between the white background contrast potential and the paper fog in the electrophotographic image forming apparatus of this embodiment. The vertical axis represents the level of fog, and the horizontal axis represents the white background contrast potential (V). The vertical axis shows that at level 0, there is no fog. At the higher level on the vertical axis, the paper becomes darker. In FIG. 4, the graph A shows the level of fog at the initial operation of the apparatus, and the graph B shows the level of fog after the apparatus has printed images on 100,000 sheets of paper. As shown in FIG. 4, when the white background contrast potential (potential difference) is decreased, the fog tends to occur more easily. Generally, as the number of printing operations increases, the level of fog tends to increase. However, if the white background potential is decreased, the rate of the increase in fogging becomes considerably higher. In this embodiment, the white background contrast potential C2 in the image area IA is set to be at 180 V, which is greater than the conventional white background contrast potential, i.e., 120 V. Accordingly, the occurrence of fog is decreased and the image quality is improved in the image area IA.

Figure 5:
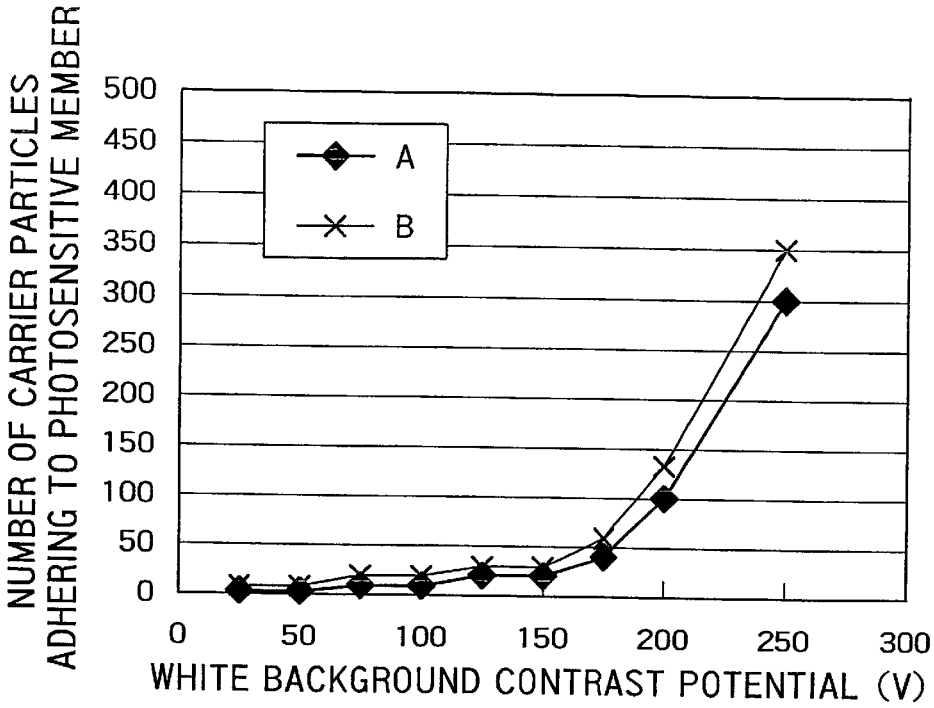
FIG. 5 shows graphs representing the relationship between the white background contrast potential (potential difference) and the number of carrier particles adhering to the photoreceptor of the electrophotographic image forming apparatus according to the embodiment of the present invention, these results obtained through experiment by the present inventor.

FIG. 5 is a graph showing the relationship between the white background contrast potential and the number of carrier particles adhering. The vertical axis represents the number of carrier particles adhering to the photoreceptor 1 measured in a portion in the size of 12 mm in length and A3 in width; and the horizontal axis represents the white background contrast potential (V). As in the case of FIG. 4, FIG. 5 shows the graph A showing the fog at the initial operation of the apparatus, and the graph B showing the fog after the apparatus has printed images on 100,000 sheets of paper. As can be understood from FIG. 5, as the white background contrast potential increases, the number of carrier particles adhering to the photoreceptor 1 increases, resulting in that scratches and/or abrasion to the photoreceptor 1 may occur more easily. Further, as the white background contrast potential increases, the rate of increase in number of carrier particles adhering to the photoreceptor 1 after the printing operation is repeated for considerable times also increases. Accordingly, in this embodiment, the white background contrast potential C1 in the non-image area NIA irrelevant to the printing operation is set to be small, i.e., 60 V. Because of this, the number of carrier particles adhering to the photoreceptor 1 in the non-image area NIA irrelevant to the printing operation is reduced, thereby reducing the possibility that the photoreceptor 1 is damaged. Generally, the number of carrier particles adhering to the photoreceptor is 50 or less in the area of 12 mm×A3.

In this embodiment, the white background contrast potential C1 in the image area IA relevant to the printing operation is set to be high, i.e., at 180 V. Accordingly, as can be understood from FIG. 5, the number of carrier particles adhering to the image area IA increases. However, although the number of carrier particles adhering to the image area IA relevant to the printing operation increases, the number of carrier particles adhering to the non-image area NIA irrelevant to the printing operation decreases. Therefore, the photoreceptor 1 is not degraded more easily as compared with conventional devices, and the life of the apparatus is not shortened as compared with the conventional apparatuses.

Thus, the electrophotographic image forming apparatus of this embodiment can improve the image quality without shortening the life thereof.

Moreover, in this embodiment, the white background contrast potential C2 in the image area IA relevant to the printing operation is set to be high, i.e., at 180 V. Accordingly, as can be understood from FIG. 4, even if the white background contrast potential C2 shifts slightly from the set value, the degree of fog does not increase considerably. That is, the margin of fog in the image area IA is wide. Further, since the white background contrast potential C1 in the non-image area NIA is set to be low, i.e., at 60 V, the margin of the number of carrier particles adhering to the non-image area NIA is wide. Since the margins of the fog and the number of carrier particles adhering are wide, it is not necessary to strictly control the white background contrast potential, resulting in that it is not necessary to provide any photoreceptor potential sensor, which has been provided to conventional apparatuses. Accordingly, it is possible to avoid increase in size and cost of the apparatus. Particularly this has a great influence on a four-drum tandem color electrophotographic image forming apparatus, which is popular at present, since four photoreceptors are used in this type of electrophotographic image forming apparatus.

Furthermore, as a result of the experiment by the present inventor, it is possible to obtain the above-described effects without using special materials for the photoreceptor 1, the magnetic carrier, the non-magnetic toner, the charging unit 3, etc. Accordingly, from this point of view, it is possible to prevent the cost from increasing.

As described above, according to this embodiment, it is possible to provide an electrophotographic image forming apparatus, which can produce a high-quality image, without increasing the size and the cost, and without reducing the life thereof.

Figure 6:
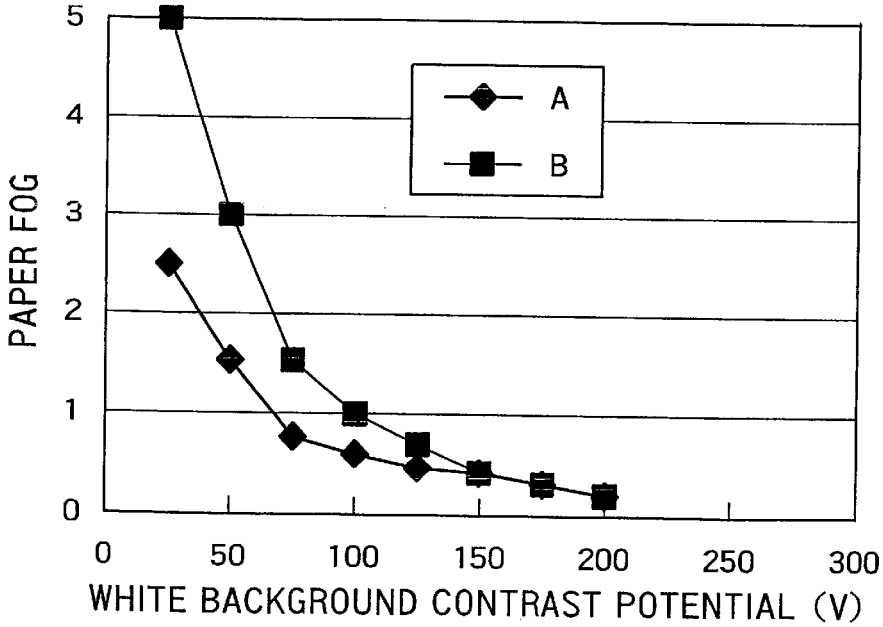
FIG. 6 shows graphs representing the relationship between the white background contrast potential (potential difference) and the paper fog of the electrophotographic image forming apparatus according to the embodiment of the present invention when the development contrast potential is changed, these results obtained through experiment by the present inventor.

If, besides the white background control means 2, a development bias control means 23 for changing the development bias potential V, and a toner adhesion sensor 24 for sensing the amount of toner adhering to the photoreceptor 1 to obtain an optimum image density based on the relationship among the sensed amount, the second white background potential V2, and the development bias V, are provided to the electrophotographic image forming apparatus of this embodiment described above, a better result will be obtained. As shown in FIG. 6, even if the value of the white background potential is the same, the degree of fog is higher in the case B where the development contrast potential (the difference between the photoreceptor exposing potential V3 and the development bias V in FIG. 3) is excessive as compared with the case A where the development contrast potential is optimum. Accordingly, the degree of the fog can be further reduced by detecting the amount of toner adhering to the photosensitive member 1 corresponding to the value of the development bias V supplied from the development bias control means 23 by the toner adhesion sensor 24 to obtain the optimum value of the development bias V (optimum image density).

Although there are the margin areas MA in the image area IA relevant to the printing operation (FIG. 3), the margin areas MA can be eliminated so that the image area IA matches the copying area CA.

Moreover, if necessary, the values of the white background contrast potential and the development bias of the electrophotographic image forming apparatus of this embodiment can be changed. Although the white background contrast potential C2 of the image area IA relevant to the printing operation is set to be at 180 V, the white background contrast potential C1 of the non-image area NIA irrelevant to the printing operation is set to be at 60 V, and the difference between the two white background contrast potentials is set to be 120 V in this embodiment, these values can be changed. According to the experiment performed by the present inventor, in a full-color electrophotographic image forming apparatus, optimal results are obtained when the difference between the two white background potentials is set to be 60 V or more and 120 V or less.

In addition, although the toner is negatively charged and the white background potential of the photoreceptor 1 is negative in the electrophotographic imaging apparatus of this embodiment, whether these are positively charged or negatively charged may be decided depending upon necessity.

Further, although the scorotron charging unit is used in the electrophotographic image forming apparatus of this embodiment, another type of non-contact charging unit or a contact-type charging unit utilizing a roller or brush may be used instead. In the case of a contact-type charging unit, the white background contrast potential can be controlled by varying the DC voltage components, etc. to be applied.

If an exposing unit uses a laser, the white background contrast potentials of the image area IA and the non-image area NIA can be controlled by controlling the value of laser bias. Specifically, in the imager area IA, the value of laser bias is set to be low, and in the non-image area NIA, the laser bias is set to be high.

It is preferable that the 50% average particle size (D50) of the carrier in the developer in this embodiment is 30 $\mu$m or more and 70 $\mu$m or less, and that the carrier includes more than 0% and less than 1% of particles, the size of which is less than 22 $\mu$m. With such a carrier, it is possible to achieve a high-quality image with the occurrence of damage to the photoreceptor being inhibited. According to the experiment by the present inventor, if the average particle size of the carrier is 70 μm or more, the toner supplying/recovering capability of the development roller 11 decreases, resulting in that the resolution of image or the reproductivity of highlight is lowered, or the degree of scattering of toner to the non-image area is increased. Further, if the average particle size of the carrier is 30 μm or less, the number of carrier particles moving from the development roller 11 to the photoreceptor 1 increases, resulting in that the scratch and/or abrasion to the photoreceptor occurs, thereby causing a defective image. Thus, it is preferable that the average particle size of the carrier is 30 μm or more and 70 μm or less in order to obtain a high-quality image with the occurrence of scratches and/or abrasion to the photoreceptor 1 being inhibited. Moreover, according to the experiment by the present inventor, a higher quality image can be obtained if the average particle size is 35 μm or more and 65 μm or less, and an even higher quality image can be obtained if the average particle size is 35 μm or more and 50 μm or less. In addition, according to the experiment by the present inventor, the image quality can be improved by adding a small amount of carrier particles, the size of which is less than 22 μm. However, if the rate of the carrier particles of 22 μm in size is 1% or more, the number of carrier particles adhering to the photoreceptor 1 increases.

Furthermore, although the photoreceptor 1 is in the shape of drum in the electrophotocraphic image forming apparatus of this embodiment, it may also be in the shape of head.

What is claimed is:

1. An electrophotographic image forming apparatus comprising:

a photoreceptor which is rotatable, and a surface of which can be uniformly charged at a voltage level, the surface attracting a toner for printing with an electrostatic force, the toner being transferred to an object to be printed on, such as paper, to perform a printing operation, and said photoreceptor rotating predetermined times during the printing operation;

a charging unit for charging the surface of the photoreceptor to be either at a first white background potential or at a second white background potential;

an exposing unit for forming an electrostatic print pattern on the surface of said photoreceptor set to be at the second white background potential, to form a latent image;

a developing unit having a rotatable development roller, which rotates with a developer adhering to the surface thereof, the developer including a carrier and the toner attracting each other by an electrostatic force, the toner adhering to the latent image on the surface of the photoreceptor by the electrostatic force, a development bias being applied to the development roller, a potential difference between the development bias and the first white background potential being a first contrast potential, a potential difference between the development bias and the second white background potential being a second white background contrast potential, and an absolute value of the second white background contrast potential being greater than an absolute value of the first white background potential; and a control unit for controlling the charging unit so that a part of a total surface area corresponding to all the turns of the photoreceptor during a printing operation is charged to be at the second white background potential, the part corresponding to a predetermined number of turns relevant to the printing operation, and that the rest of the total surface area corresponding to the rest of turns is charged to be at the first white background potential.

2. The electrophotographic image forming apparatus according to claim 1, further comprising:

development bias potential controlling means for changing the value of the development bias; and a toner adhesion sensor for detecting an amount of the toner adhering to the photoreceptor, and for determining an optimum image density based on the relationship among the detected amount, the second white background potential, and the development bias.

3. The electrophotographic image forming apparatus according to claim 1, wherein the difference between the absolute value of the second white background contrast potential and the absolute value of the first white background contrast potential is 60 V or more and 120 V or less.

4. The electrophotographic image forming apparatus according to claim 1, which is a four-photoreceptor tandem full-color electrophotographic image forming apparatus including four of said photoreceptor.

5. A development method using an electrophotographic image forming apparatus, comprising:

rotating a photoreceptor predetermined times, charging a first part of the total surface area corresponding to all the turns of the photoreceptor to be at a first white background potential by the use of a charging unit, the first part being irrelevant to a printing operation;

charging a second part of the total area of the photoreceptor relevant to the printing operation to be at a second white background potential, the value of the second white background potential being different from that of the first white background potential;

forming an electrostatic pattern of a latent image on the second part of the total surface area of the photoreceptor charged to be at the second white background potential by the use of an exposing unit, supplying a developer composed of a toner and a carrier attracting each other by an electrostatic force to the latent image on the second part of the total surface area of the photoreceptor by the use of a development roller charged to be at a development bias potential; and allowing the toner to adhere to the latent image on the second part of the total surface of the photoreceptor by the electrostatic force, wherein with respect of the absolute value of the potential difference between the photoreceptor and the development roller, the absolute value of a second contrast potential, which is the potential difference between the second white background potential of the second part relevant to the printing operation and the development bias potential of the development roller is larger than the absolute value of a first contrast potential, which is the potential difference between the first white background potential of the first part irrelevant to the printing operation and the development bias potential.

6. The development method according to claim 5, wherein an average particle size of the carrier is larger than that of the toner, a 50% average particle size of the carrier is 30 μm or more and 70 μm or less, and the carrier includes more than 0% and less than 1% of particles, the size of which is 22 μm or less.

7. The development method according to claim 5, wherein the difference between the absolute value of the second white background contrast potential and the absolute value of the first white background contrast potential is 60 V or more and 120 V or less.

* * * * *